US005993099A

United States Patent [19]

Greenberg et al.

[11] Patent Number: 5,993,099

[45] Date of Patent: Nov. 30, 1999

[54] COMBINATION NOTEBOOK/FILE FOLDER HAVING RETRACTABLE AND EXTENDIBLE HANGERS

[75] Inventors: Mitchell Greenberg; Jacobo Feldman, both of Boca Raton, Fla.

[73] Assignee: Rollabind Inc., Pompano Beach, Fla.

[21] Appl. No.: 09/050,596

[22] Filed: Mar. 30, 1998

[51] Int. Cl.[6] ..... B42F 3/00

[52] U.S. Cl. ..... 402/4; 211/42; 229/67.2; 281/43

[58] Field of Search ..... 211/42; 229/67.2; 281/43; 402/4

[56] References Cited

U.S. PATENT DOCUMENTS

| | | | |
|---|---|---|---|
| 3,255,758 | 6/1966 | Gauche | 129/16.7 |
| 3,801,175 | 4/1974 | Giulie | 312/184 |
| 3,865,445 | 2/1975 | Dean et al. | 312/184 |
| 3,957,312 | 5/1976 | Rose | 312/184 |
| 4,114,963 | 9/1978 | Menahem | 312/184 |
| 4,133,590 | 1/1979 | Young | 312/183 |
| 4,400,107 | 8/1983 | Pitts | 402/4 |
| 4,979,626 | 12/1990 | Pitts | 211/45 |
| 5,015,144 | 5/1991 | Miller . | |
| 5,197,762 | 3/1993 | Abramov | 281/43 |
| 5,340,156 | 8/1994 | Bianco . | |
| 5,456,369 | 10/1995 | Smed | 211/42 |
| 5,540,512 | 7/1996 | Pinzauti . | |
| 5,553,959 | 9/1996 | Feldman et al. . | |
| 5,572,815 | 11/1996 | Kovner . | |
| 5,593,184 | 1/1997 | Dengler | 281/43 |
| 5,722,692 | 3/1998 | Abramov | 281/43 |

FOREIGN PATENT DOCUMENTS

| | | |
|---|---|---|
| 625130 | 9/1961 | Italy . |
| 71937 | 3/1953 | Netherlands . |

*Primary Examiner*—Andrea L. Pitts
*Assistant Examiner*—Monica Smith
*Attorney, Agent, or Firm*—Frishauf, Holtz, Goodman, Langer & Chick, P.C.

[57] ABSTRACT

A combination notebook/file folder includes a first side panel having upper and lower edges, a second side panel having upper and lower edges, channels in the upper edges of the first and second side panels. The combination also includes a binding edge which connects together the lower edges of the first and second side panels, a plurality of binding rings in the binding edge for holding a plurality of sheets of paper therein, and left and right hangers selectively retractably and extensively mounted in the channels at the upper edges of each of the first and second side panels. Each hanger includes a main body, a hook at an outer end of the main body and a post extending from each main body and engaged within a respective elongated slot for limiting sliding movement of the hangers in the channels. Each main body is elongated and includes a cut away portion at an inner end opposite the hook to form a reduced width portion. The reduced width portions of the hangers of the first panel overlap each other, and the reduced width portions of the hangers of the second panel overlap each other. The combination notebook/file folder can be used as a hanging file folder when the left and right hangers extend out from the upper edges, and can be used as a notebook when the left and right hangers are retracted into the upper edges.

23 Claims, 3 Drawing Sheets

COMBINATION NOTEBOOK/FILE FOLDER HAVING RETRACTABLE AND EXTENDIBLE HANGERS

BACKGROUND OF THE INVENTION

1. Field of the Invention

The present invention application relates generally to file folders, and more particularly to a combination notebook/file folder having retractable and extendible hangers.

2. Description of the Related Art

Traditional hanging file folders include first and second panels connected together at their lower edges with hangers fixed to the upper edges. The hangers typically extend outwardly from the side edges such that when the folder is placed in a file drawer, the rails within the draw support the hangers.

Traditionally, when it is desired to retrieve papers from a hanging file folder, the papers are removed while the corresponding folder remains in the drawer. As a result, the papers that have been removed are loose, and can quickly become disorganized. Alternatively, the entire hanging folder including the corresponding papers is removed from the drawer. However, in such case, the hangers continue to extend from side edges of the hanging file folder. This makes the file folder difficult to carry because the hangers often get caught on objects and because the hangers do not enable the file folder to readily fit in a standard size briefcase. Further, even when the hanging file folder is removed from the file drawer, the papers are still loosely held therein, making management of the papers difficult and disorganization highly likely.

SUMMARY OF THE INVENTION

It is therefore, an object of the present invention to provide a combination notebook/file folder which overcomes the aforementioned and inherent disadvantages and drawbacks of traditional hanging file folders.

It is another object of the present invention to provide a combination notebook/file folder that can be used as both a conventional notebook and as a conventional hanging file folder.

It is still another object of the present invention to provide a combination notebook/file folder having retractable and extendible hangers, such that the combination notebook/file folder can be used as a hanging file folder when the hangers are in an extended position and can be used as a notebook when the hangers are in a retracted position.

It is yet another object of the present invention to provide a combination notebook/file folder having binder rings that can retain papers in an organized manner.

It is a further object of the present invention to provide a combination notebook/file folder that provides a single construction which takes the place of two separate, distinct and specialized constructions according to the prior art, thereby reducing space and costs.

In accordance with one form of the present invention, a combination notebook/file folder includes a first side panel having upper and lower edges, a second side panel having upper and lower edges, a binding edge interposed between the lower edges of the first and second side panels for coupling the first and second side panels, hangers selectively retractable mounted at the upper edge of each of the first and second side panels, wherein the combination notebook/file folder can be used as a hanging file folder when the hangers are extended from the upper edges of the first and second panels, and the combination notebook/file folder can be used as a notebook when the hangers are retracted into the upper edges of the first and second side panels so that the hangers do not extend therefrom.

In accordance with another form of the present invention, a combination notebook/file folder includes a first side panel having upper and lower edges, a second side panel having upper and lower edges, a binding edge interposed between the first and second side panels for coupling the first and second side panels, a plurality of binding rings coupled to the binding edge, and hangers being selectively retractably mounted at the upper edge of each of the first and second side panels, wherein the combination notebook/file folder can be used as a hanging file folder when the hangers are extended out from the upper edges of the first and second panels, and the combination notebook/file folder can be used as a notebook when the hangers are retracted into the upper edges so that the hangers do not extend from the first and second side panels.

In accordance with another form of the present invention, a combination notebook/file folder includes a first side panel having upper and lower edges, a second side panel having upper and lower edges, a binding edge interposed between the first and second side panels for coupling the first and second side panels, a paper retainment device coupled to at least one of said first side panel, said second side panel and said binding edge for holding a plurality of sheets of paper therein, and hangers selectively movably mounted proximate corresponding edges of the first and second side panels.

In accordance with another form of the present invention, apparatus for securing papers for storage in a file draw includes a panel having upper and lower edges, a paper retainment device coupled to the panel, and hangers selectively retractably mounted proximate the upper edge of said panel, wherein said apparatus can be used in a hanging manner when said hangers are extended out from said retainment panel, and said apparatus can be used as a notepad when said hangers are retracted into said retainment panel.

The above and other objects, features and advantages of the invention will become readily apparent from the following detailed description thereof, which is to be read in connection with the accompanying drawings.

DETAILED DESCRIPTION OF THE PREFERRED EMBODIMENTS

Figure 1:
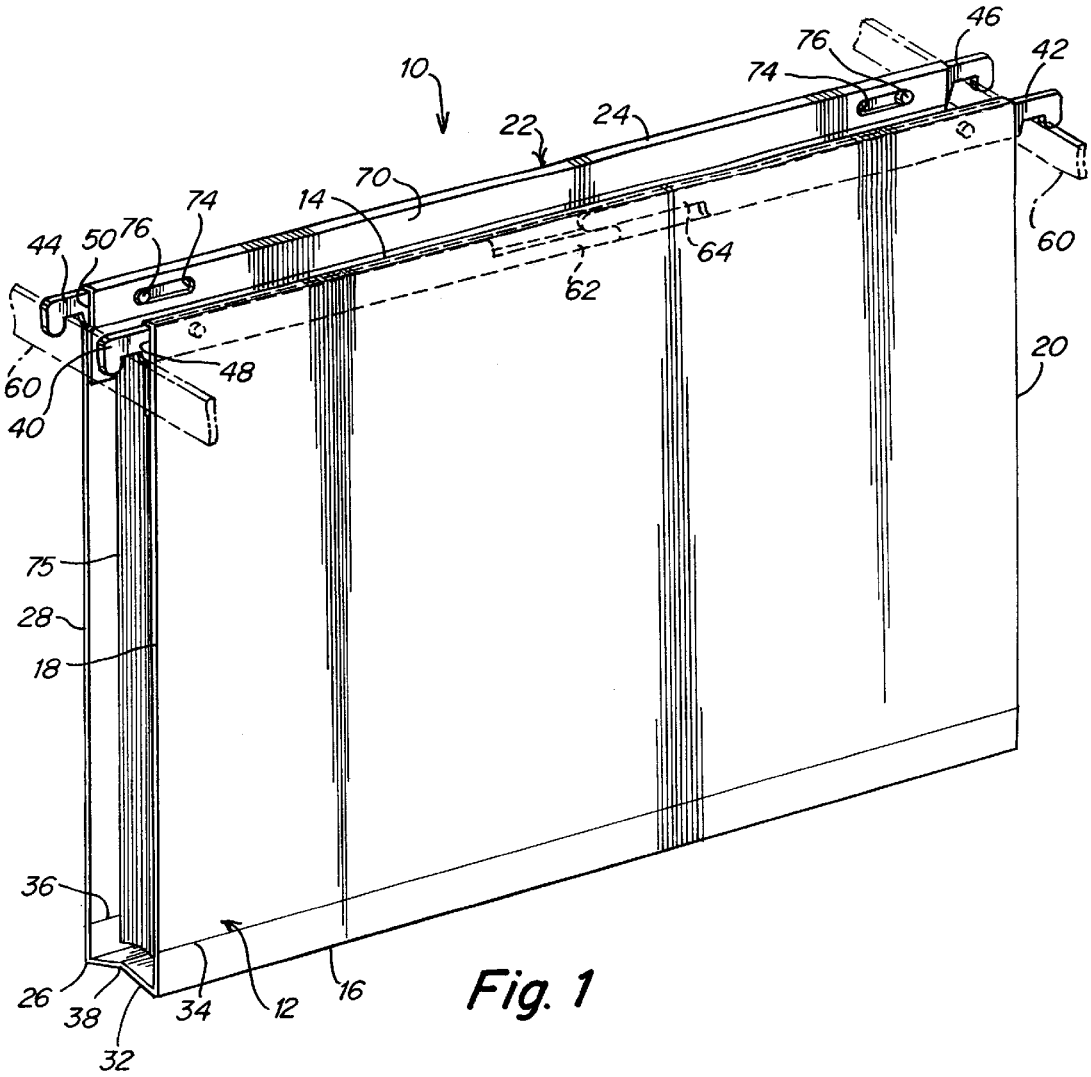
FIG. 1 is a perspective view of a combination notebook/file folder according to the present invention, with the hangers in an extended position for use as a file folder, and shown hanging on file draw rails (shown in phantom)
Figure 2:
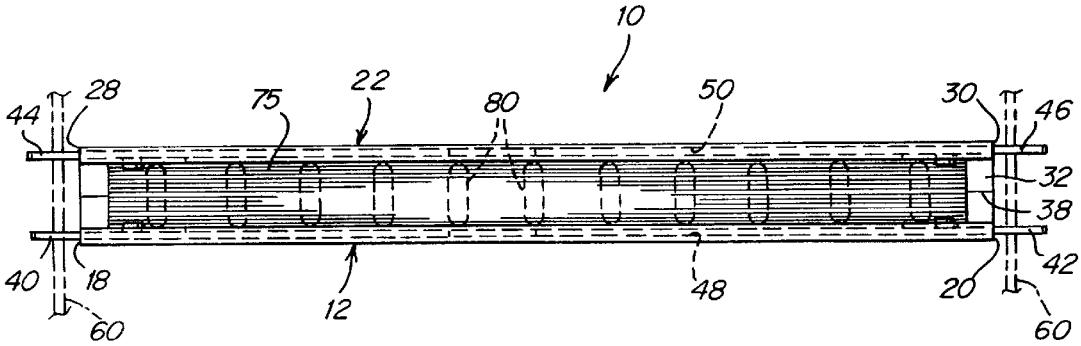
FIG. 2 is a top plan view of the combination notebook/file folder of FIG. 1.

Referring now to the drawings in detail, a combination notebook/file folder 10 in accordance with the present invention includes a first side panel 12 having an upper edge 14, a lower edge 16, a left side edge 18 and a right side edge 20. The folder 10 also includes a second rectangular side panel 22 having an upper edge 24, a lower edge 26, a left side edge 28 and a right side edge 30. The first and second side panels 12, 22 can be made of any suitable material, such as plastic, cardboard, paperboard, etc. However, a plastic material is preferred. Whichever material is used, the material preferably has some degree of flexibility, durability and resilience.

A narrow rectangular binding edge 32 connects lower edge 16 of the first side panel 12 to lower edge 26 of the second side panel 22. Preferably, binding edge 32 is made of the same material as side panels 12 and 22. In this regard, side panels 12 and 22 and binding edge 32 can be made from a single blank, provided with fold lines along lower edges 16 and 26.

Additional fold lines 34 and 36 can be provided in side panels 12 and 22, adjacent, parallel to, and slightly spaced from lower edges 16 and 26, to aid in moving the side panels 12 and 22 into parallel relation with each other as a hanging file folder or as a closed notebook. In addition, a further fold line 38 bisects binding edge 32 in the lengthwise direction thereof, to aid in operation of the combination as a notebook.

Figure 3:
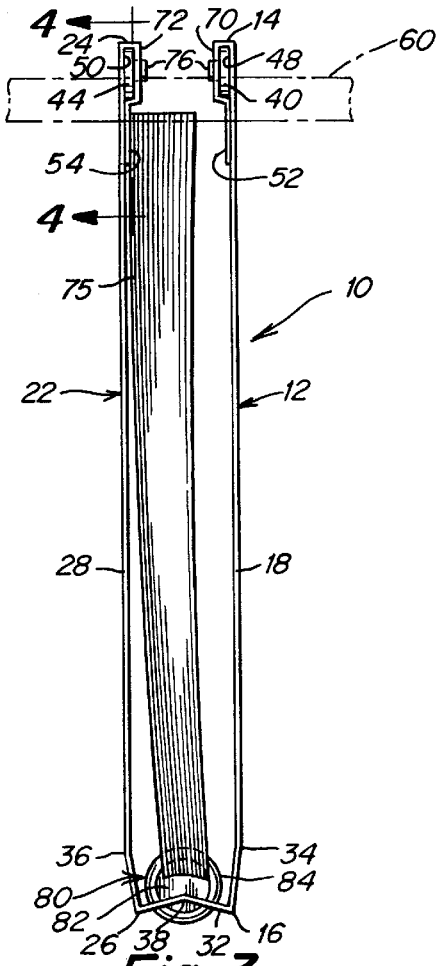
FIG. 3 is an end elevational view of the combination notebook/file folder of FIG. 1.
Figure 4:
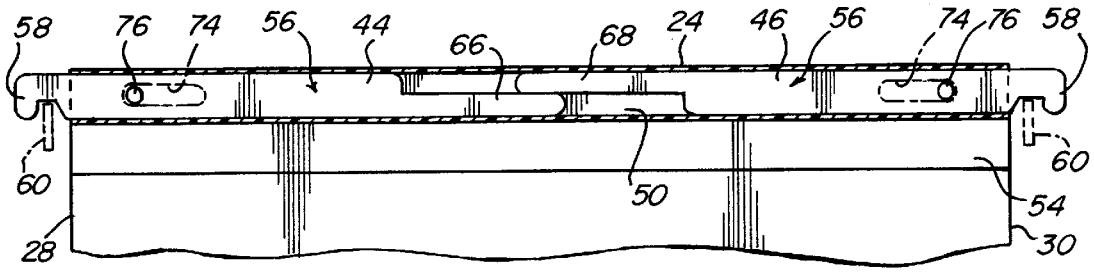
FIG. 4 is a fragmentary cross-sectional view of the combination notebook/file folder, taken along line 4—4 of FIG. 3, showing the hangers in an extended position.
Figure 5:
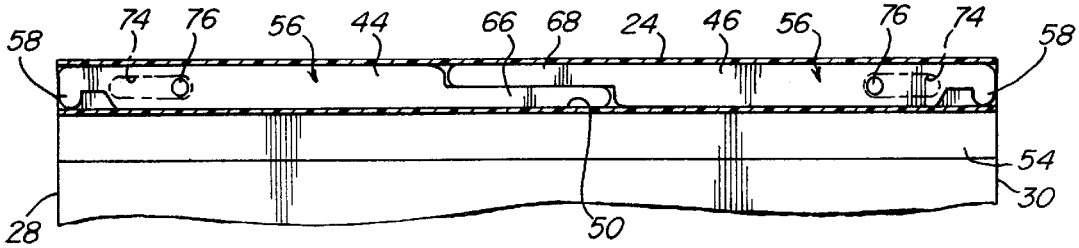
FIG. 5 is a fragmentary cross-sectional view similar to FIG. 4, but with the hangers retracted.

Side panel 12 includes a left hanger 40 and a right hanger 42 selectively retractably mounted at the upper end thereof. Likewise, side panel 22 includes a left hanger 44 and a right hanger 46 selectively retractably mounted at the upper end thereof. In order to secure and enable retraction of the left and right hangers, a lengthwise channel 48 is formed at the upper end of side panel 12 for receiving left and right hangers 40 and 42. Likewise, a lengthwise channel 50 is formed at the upper end of side panel 22 for receiving left and right hangers 44 and 46. Each channel 48 and 50 is preferably formed by folding over onto itself and adhering thereto an edge portion of the blank used to form the combination notebook/file folder, respectively indicated by 52 and 54 as best shown in FIG. 3. As a result, hangers 40, 42, 44 and 46 are secured within channels 48 and 50, as shown in FIG. 5, and can be extended out from channels 48 and 50, as shown in FIG. 4. When left and right hangers 40, 42, 44 and 46 are extended out from channels 48 and 50, the combination notebook/file folder 10 can be used as a hanging file folder, and when left and right hangers 40, 42, 44 and 46 are retracted into channels 48 and 50 (as shown in FIG. 5), the combination notebook/file folder 10 can be used as a notebook.

Figure 6:
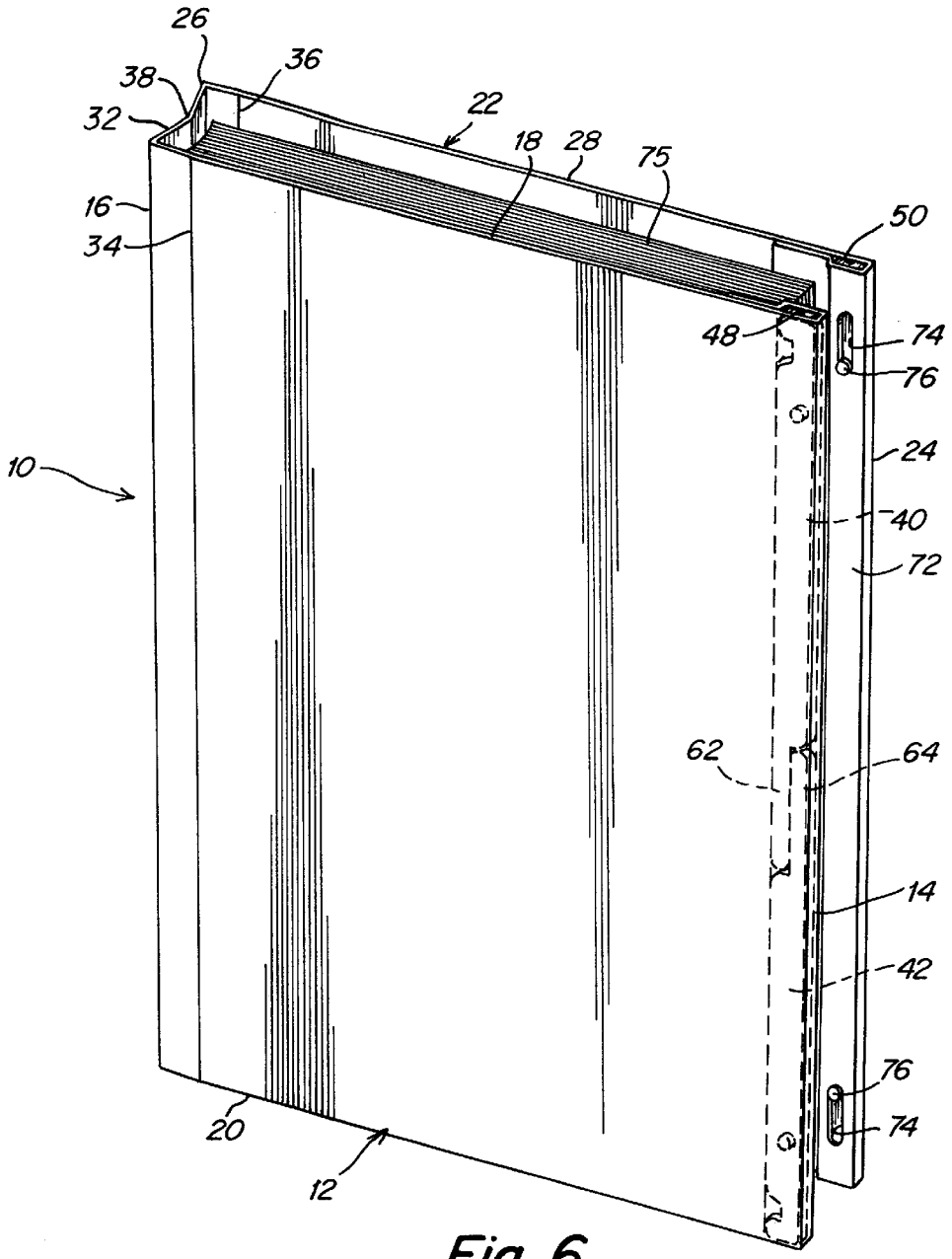
FIG. 6 is a perspective view of the combination notebook/file folder, with the hangers retracted, and ready for use as a notebook.

As best shown in FIGS. 4 and 5, each hanger 40, 42, 44 and 46 includes a flat, elongated main body 56 (made of plastic or metal) that slides within the respective channels 48 and 50. Each hanger also includes a downward facing hook 58 at an outer end thereof, for engaging a file drawer rail 60 in order to support the folder thereon in a hanging manner. The main bodies 56 of hangers 40, 42 and hangers 44, 46 are cut away at their inner ends to form reduced width portions 62, 64 and reduced width portions 66, 68, respectively. As best shown in FIGS. 4–6, reduced width portions 62 and 64 overlap in channel 48, while reduced width portions 66 and 68 overlap in channel 50. The substantially complete overlap in the retracted position provides rigidity to the combination notebook/file folder 10 when it is used as a notebook. In addition, by having at least a portion of the hangers extend along the length of the folder when the hangers are in an extended position as shown in FIG. 4, the combination has rigidity when used as a folder.

In order to aid in movement of hangers 40, 42, 44 and 46 between the retracted (FIG. 5) and extended positions (FIG. 4), the inner walls 70 and 72 of respective channels 48 and 50 include an elongated lengthwise slot 74. In addition, the inner surfaces of hanger main bodies 56 include cylindrical posts 76 that extend through slots 74 such that the upper surfaces of posts 76 are at least substantially coplanar with inner, walls 70 and 72. As a result, this configuration does not interfere with the placement of papers 75 into, and removal of papers 75 from, the combination notebook/file folder 10. Further, slots 74 and posts 76 serve to limit the extent of retraction and extension of hangers 40, 42, 44 and 46 and serve as a guide for a laser. In this regard, it is only necessary to push posts 76 with a finger to the left or right of the respective slots 74 in order to retract or extend hangers 40, 42, 44 and 46.

It will be appreciated, however, that any other suitable sliding arrangement can be provided for hangers 40, 42, 44 and 46. For example, each hanger may be provided with elongated slots which receive posts fixed in the channels. Alternatively, channels 48 and 50 can be eliminated, with posts 76 having enlarged heads to retain hangers 40, 42, 44 and 46 thereon.

In order to use the combination notebook/file folder 10 as a notebook, the combination also includes a plurality of binding rings 80 centrally located in binding edge 32 for holding a plurality of papers 75 therein. Preferably, binding rings 80 and the binding arrangement are of the type disclosed in U.S. Pat. No. 5,553,959, issued Sep. 10, 1996, and U.S. patent application Ser. No. 08/696,390, filed Aug. 14, 1996, the entire disclosures of each is incorporated herein by reference.

Figure 8:
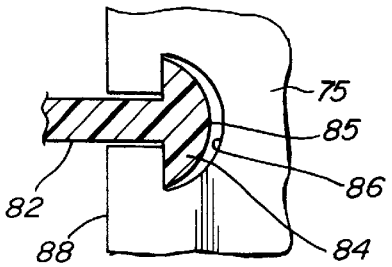
FIG. 8 is a cross-sectional view of one binding ring being coupled to a piece of paper.

In the preferred embodiment, as best shown in FIG. 8, each binder ring 80 has a central, circular flat surface portion 82, with an enlarged continuous mushroom-shaped rim 84 extending around the entire periphery of circular flat surface portion 82. The binder ring also preferably has an arcuate outer surface 85. Correspondingly, each sheet of paper 75 has an open portion 86 along one edge 88 thereof which coincides with the configuration of binder ring 80 in order to be engaged and removably secured thereto.

Figure 7:
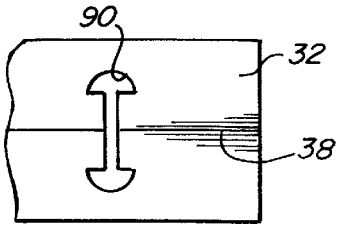
FIG. 7 is a bottom plan fragmentary view of the binding edge with the binding rings removed.

As shown in FIG. 7, binding edge 32 includes a plurality of spaced dumbbell shaped openings 90 therein. Each opening 90 traverses and bisects fold line 38. In this regard, the enlarged continuous rims 84 are snapped into openings 90 and held therein, and open portions 86 of paper 75 are then inserted over the enlarged continuous rims 84 between the first and second side panels 12, 14 to be held by the binding rings 80 within the combination notebook/file folder 10.

The present invention is not limited to the aforementioned binder rings 80, and other types of binder rings can be used, for example, those of the type shown in U.S. Pat. No. 5,340,156, the entire disclosure of which is incorporated herein by reference. In addition, any standard method of securing papers within an enclosure having front and back covers or a single backing sheet can be employed such as, for example, an ACCO-type system or a three-ring binder system. Moreover, the binding rings or its equivalent need not be positioned at a lower edge of a side panel, but could be located at an upper edge or a side edge. Furthermore, while two separate and distinct hangers are shown and described for each side panel, it is foreseen that one hanger which is capable of being retracted and expanded can be utilized for each side panel, or if the hangers are positioned proximate the binding edge 32, only one set of hangers would be required to support the combination.

It will therefore be appreciated that the present invention can be used as a hanging file folder by merely extending hangers 40, 42, 44 and 46 outwardly from channels 48 and 50, and can be used as a notebook, without fear of interference from the hangers, by retracting hangers 40 42, 44 and 46 back into channels 48 and 50. Thus, a single construction according to the present invention takes the place of two separate, distinct and specialized constructions according to the prior art, thereby reducing space and costs. Further, regardless of whether the combination notebook/file folder 10 is used as a hanging file folder or a notebook, papers 75 can be held therein in an organized manner by binder rings 80.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A notebook/file folder, comprising:

a first side panel having upper and lower edges;

a second side panel having upper and lower edges;

a binding edge interposed between said lower edges of said first and second side panels for coupling said first and second side panels; and hangers selectively retractably mounted at the upper edge of at least one of each of said first and second side panels, wherein at least one of said first and second side panels includes first and second hangers each having a main body, an outer end and an inner end opposite the outer end, at least one of said first and second hangers having at least one of an elongated portion and a cut away portion at the inner end thereof to form a reduced width portion, the reduced width portion being overlapable with the inner end of the other of said first and second hanger; and wherein said notebook/file folder is usable as a hanging file folder when said first and second hangers are extended out from said upper edges of said at least one of said first and second panels, and said notebook/file folder is usable as a notebook when said first and second hangers are retracted into said upper edges of a corresponding one of said first and second side panels so that the first and second hangers do not extend therefrom.

2. The notebook/file folder according to claim 1, wherein said upper edges include channels therein defined by walls, and said hangers are positioned in said channels.

3. The notebook/file folder according to claim 2, further including an arrangement for limiting an extent of movement of said hangers.

4. The notebook/file folder according to claim 3, wherein said arrangement includes elongated slots in said walls which define each said channel, and a post extending from each said hanger and engaged within a respective one of said elongated slots.

5. The notebook/file folder according to claim 1, wherein each said hanger includes a hook at the outer end.

6. The notebook/file folder according to claim 1, wherein each side panel includes first and second hangers, and wherein each said hanger includes the elongated portion and the cut away portion at an inner end thereof to form a reduced width portion, the reduced width portions of the first and second hangers of the first panel being overlapable with each other, and the reduced width portions of the first and second hangers of the second panel being overlapable with each other.

7. A notebook/file folder, comprising:

a first side panel having upper and lower edges;

a second side panel having upper and lower edges;

a binding edge interposed between said first and second side panels for coupling said first and second side panels;

a plurality of binding rings coupled to said binding edge; and hangers selectively retractably mounted at the upper edge of at least one of said first and second side panels;

wherein at least one of said first and second side panels includes first and second hangers each having a main body, an outer end and an inner end opposite the outer end, at least one of said first and second hangers having at least one of an elongated portion and a cut away portion at the inner end thereof to form a reduced width portion, the reduced width portion being overlapable with the inner end of the other of said first and second hangers, and wherein said notebook/file folder is usable as a hanging file folder when said first and second hangers are extended out from said upper edges of said at least one of said first and second panels, and said notebook/file folder is usable as a notebook when said first and second hangers are retracted into said upper edges of a corresponding one of said first and second side panels so that the hangers do not extend therefrom.

8. The notebook/file folder according to claim 7, wherein said upper edges include channels therein defined by walls, and said hangers are positioned in said channels.

9. The notebook/file folder according to claim 8, further including an arrangement for limiting an extent of movement of said hangers.

10. The notebook/file folder according to claim 9, wherein said arrangement includes elongated slots in said walls which define each said channel, and a post extending from each said hanger and engaged within a respective one of said elongated slots.

11. The notebook/file folder according to claim 7, wherein each said hanger includes a hook at the outer end.

12. The notebook/file folder according to claim 7, wherein each side panel includes first and second hangers, and wherein each said hanger includes the elongated portion and the cut away portion at an inner end thereof to form a reduced width portion, the reduced width portions of the first and second hangers of the first panel being overlapable with each other, and the reduced width portions of the first and second hangers of the second panel being overlapable with each other.

13. The notebook/file folder according to claim 7, wherein each said binder ring includes a central, circular flat surface portion with an enlarged continuous rim extending around the entire periphery of the circular flat surface portion.

14. The notebook/file folder according to claim 13, wherein the plurality of binding rings is capable of holding a plurality of sheets of paper, and wherein each said sheet of paper has open portions along one edge thereof which correspond to a configuration of the binder rings so as to be engaged and retained thereby.

15. The notebook/file folder according to claim 13, wherein at least one of said first side panel, said second side panel, and said binding edge includes a plurality of spaced openings therein for receiving and holding a plurality of said binding rings thereto.

16. A notebook/file folder, comprising:

a first side panel having upper and lower edges;

a second side panel having upper and lower edges;

a binding edge interposed between said first and second side panels for coupling said first and second side panels;

a paper retainment device coupled to at least one of said first side panel, said second side panel and said binding edge for securing a plurality of sheets of paper; and hangers selectively movably mounted proximate corresponding edges of at least one of said first and second side panels;

wherein at least one of said first and second side panels includes first and second hangers each having a main body, an outer end and an inner end opposite the outer end, at least one of said first and second hangers having at least one of an elongated portion and a cut away portion at the inner end thereof to form a reduced width portion, the reduced width portion being overlapable with the inner end of the other of said first and second hanger.

17. The combination notebook/file folder according to claim 16 wherein the paper retainment device comprises a plurality of binding rings.

18. Apparatus for securing papers and for use in a file draw comprising:

a retainment panel having upper and lower edges;

a paper retainment device coupled to said panel; and hangers selectively movably mounted to said retainment panel;

wherein said retainment panel includes first and second hangers each having a main body, an outer end and an inner end opposite the outer end, at least one of said first and second hangers having at least one of an elongated portion and a cut away portion at the inner end of the at least one of said first and second hangers to form a reduced width portion, the reduced width portion being overlapable with the inner end of the other of said first and second hangers, and wherein said apparatus is usable in a hanging manner when said hangers are extended out from said retainment panel, and said apparatus is usable as a note pad at least when said hangers are retracted into said retainment panel.

19. The apparatus according to claim 18, wherein the paper retainment device comprises a plurality of binding rings.

20. The apparatus according to claim 18, wherein the paper retainment device is coupled to said lower edge of said panel and said hangers are mounted at an upper edge of said panel.

21. A notebook/file folder, comprising:

a first side panel having upper and lower edges;

a second side panel having upper and lower edges;

a binding edge interposed between said first and second side panels for coupling said first and second side panels;

a plurality of binding rings coupled to said binding edge; and hangers selectively retractably mounted at the upper edge of at least one of said first and second side panels;

wherein said notebook/file folder is usable as a hanging file folder when said hangers are extended out from said upper edges of said first and second panels, and said notebook/file folder is usable as a notebook at least when said hangers are retracted into said upper edges so that the hangers do not extend from said at least one of said first and second side panels wherein each said binder ring includes a central, circular flat surface portion with an enlarged continuous rim extending around the entire periphery of the circular flat surface portion.

22. The combination notebook/file folder according to claim 21, wherein the plurality of binding rings is capable of holding a plurality of sheets of paper, and wherein each said sheet of paper has open portions along one edge thereof which correspond to a configuration of the binder rings so as to be engaged and retained thereby.

23. The combination notebook/file folder according to claim 21, wherein at least one of said first side panel, said second side panel, and said binding edge includes a plurality of spaced openings therein for receiving and holding a plurality of said binding rings thereto.

* * * * *